United States Patent [19]

Balavich

[11] Patent Number: 5,065,875

[45] Date of Patent: Nov. 19, 1991

[54] COMPOSITE CONTAINERS

[75] Inventor: Nancy P. Balavich, New York, N.Y.

[73] Assignee: Revlon, Inc., New York, N.Y.

[21] Appl. No.: 547,645

[22] Filed: Jul. 3, 1990

Related U.S. Application Data

[63] Continuation-in-part of Ser. No. 410,671, Sep. 11, 1989, and Ser. No. 405,838, Sep. 11, 1989.

[51] Int. Cl.[5] ..... B65D 21/02

[52] U.S. Cl. ..... 215/10; 206/504; 220/23.4

[58] Field of Search ..... 215/6, 10, 316; 220/23.4, 23.83; D9/347; 206/504

[56] References Cited

U.S. PATENT DOCUMENTS

| | | | |
|---|---|---|---|
| D. 100,412 | 7/1936 | Carp | 215/6 X |
| D. 219,642 | 1/1971 | Prahs | D9/347 |
| D. 220,864 | 6/1971 | Weckman | D9/18 |
| 251,566 | 12/1881 | Fuller | 215/6 |
| D. 270,429 | 9/1983 | Anderson | D9/347 |
| 519,601 | 5/1894 | Dryfoos | 215/6 |
| 849,211 | 4/1907 | Daly . | |
| 2,374,092 | 4/1945 | Glaser | 215/6 |
| 2,493,922 | 1/1950 | Miller | 215/6 |
| 2,780,225 | 2/1957 | Barr et al. | 215/6 X |
| 3,590,989 | 12/1971 | Wittwer | 206/568 |
| 4,235,343 | 11/1980 | Thompson | 215/10 X |
| 4,640,423 | 2/1987 | Mednis | 215/10 |
| 4,673,094 | 6/1987 | Mednis | 215/10 |
| 4,708,253 | 11/1987 | Mednis | 215/10 |
| 4,925,066 | 5/1990 | Rosenbaum | 215/10 X |
| 4,950,083 | 8/1990 | Bavaveas | 215/10 X |

FOREIGN PATENT DOCUMENTS

| | | | |
|---|---|---|---|
| 729092 | 12/1942 | Fed. Rep. of Germany | 215/6 |
| 2375105 | 8/1978 | France | 215/316 |
| 34758 | 1/1935 | Netherlands | 215/6 |
| 301579 | 11/1954 | Switzerland | 215/316 |

*Primary Examiner*—Sue A. Weaver
*Attorney, Agent, or Firm*—Julie Blackburn

[57] ABSTRACT

A double container comprised of a first larger container into which is removably nested a second smaller container.

14 Claims, 5 Drawing Sheets

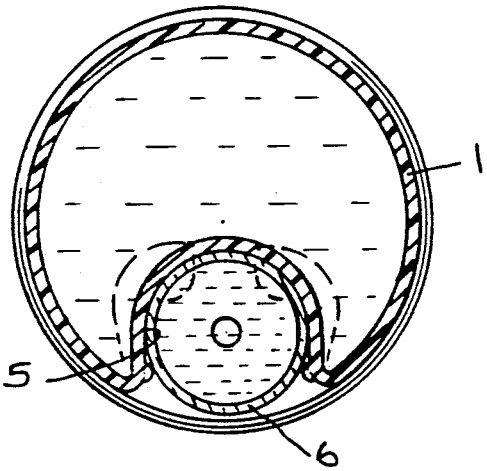
Fig. 4.
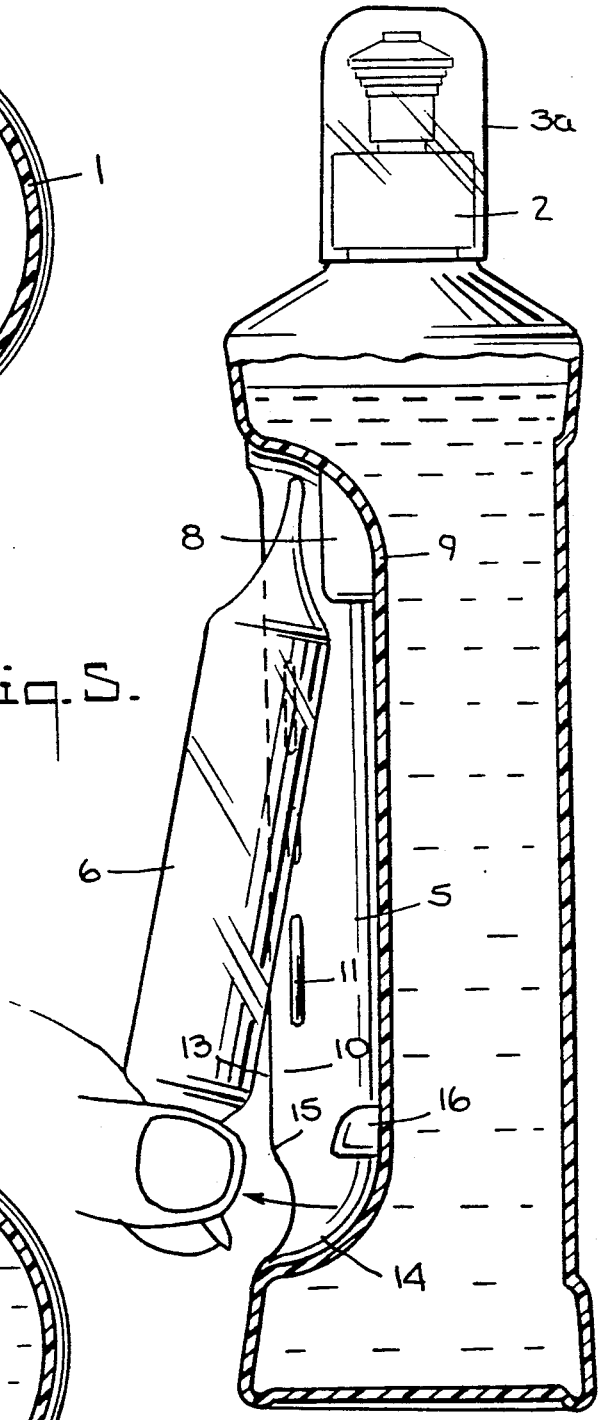
Fig. 5.
Fig. 6.
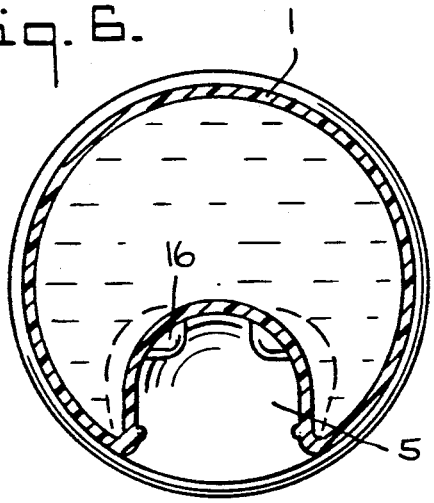

COMPOSITE CONTAINERS

This application is a continuation-in-part of U.S. patent application Ser. Nos. 07/410,671 and 07/405,838 both filed Sept. 11, 1989.

TECHNICAL FIELD

The invention is directed to composite containers containing recessed cavities into which are nested smaller containers.

BACKGROUND OF THE INVENTION

The concept of nesting one or more smaller containers within a larger container to provide a single shelf keeping unit (SKU) is desireable when two or more materials are to be used together or close in time as part of a single process. This allows mixing of reagents together immediately prior to use to ensure freshness or in the case when two or more substances are not stable together; reduces loss or misplacement of smaller containers; and facilitates storage of the entire unit. Nested containers are very desireable for items such as shampoo/conditioner, permanent wave solution/active substance, hair dye solution/active substance, and so on. These units are usually comprised of a larger container which contains the main liquid and a smaller nested container which contains smaller amounts of a second substance designed to be used in combination or close in time to the main liquid. Nested containers are not new.

U.S. Pat. No. 251,566 dated Dec. 27, 1881 describes one of the first nested containers. It discloses a flat shouldered, glass bottle bearing on its lateral shouldered side a recessed cavity of size sufficient to hold a small glass syringe. The syringe, intended to be used for inoculating subjects with the bottle contents, is inserted into the cavity lengthwise from the top and is prevented from falling out laterally because the lateral opening of the cavity is smaller than the diameter of the syringe.

U.S. Pat. No. 519,601 dated May 8, 1894 discloses a composite glass bottle wherein a number of smaller vessels are nested into vertical recessed cavities running from shoulder to base of a larger round central bottle. The nested vessels are screw capped and held in their cavities by small vertical pipes extending upward from the screw caps to terminate into the cork of the main bottle. The main cork is then removed to allow access to the nested containers.

U.S. Pat. No. 849,211 describes a glass bottle containing a recessed cavity or pocket which extends inwardly into the bottle immediately adjacent to the bottle wall. The pocket opens at the outer surface of the bottle and is of a size sufficient to insert a label, or trademark. Once the desired item is inserted into the pocket the chamber is sealed to provide a bottle whose label is readable through the glass yet cannot be removed or obliterated.

In U.S. Pat. No. 2,493,922 the disclosed container provides a bottle with a conventional neck and stopper with channels or openings arranged in the side walls thereof for carrying a plurality of capsules. The capsules or tablets, designed to be used with the container contents, are removed from the channel by inserting a finger into the open side of the channel and moving the capsule up through the channel opening.

U.S. Pat. No. 2,780,225 describes a blood collection unit comprised of a large glass bottle containing on is outer surface two vertical recessed cavities of size sufficient to nest two test tubes. Both test tubes are removably placed in cylindrical metal holders to facilitate their easy removal to conduct lab tests, etc. The cylindrical metal holders containing both test tubes are held in the recessed cavities by a gummed label passing around the bottle.

U.S. Pat. No. 4,235,343 describes a container assembly comprised of one square flat, shouldered bottle and two smaller flat, shouldered bottles. The large bottle contains on each flat side recessed cavities of size sufficient to hold the two smaller bottles. When the smaller bottles are fitted within the cavities an uninterrupted surface contour results.

However, a chronic problem with all nested containers is securing the smaller nested container within the recessed cavity of the larger container. Labels, cylindrical tubes, pipes and other devices are used, all of which create a more cumbersome system and greatly restrict the size and shape of the smaller nested container. None of the known nested containers provide a system in which the smaller container is removably secured by snapping into the recessed cavity of the larger container.

SUMMARY OF THE INVENTION

The invention is directed to a composite container comprising a large container having on its outer surface at least one vertical recessed cavity. Into each recessed cavity a smaller container means is removably secured by snapping into the recessed cavity. The resulting container configuration provides a single shelf keeping unit. The larger container may contain more than one recessed cavity, thus providing for the nesting of more than one smaller container into the large container. The larger container may be made of plastic or any other durable material. The nested container may be plastic, glass, or any other suitable material. There are two preferred embodiments of the invention designated Embodiment 1 and Embodiment 2.

BRIEF DESCRIPTION OF DRAWINGS

Embodiment 1

FIG. 4: is a cross-sectional view of the bottle of Embodiment 1 taken across 4—4 of FIG. 2 when the ampule is in place within the recessed cavity.

FIG. 5: is a right side elevational longitudinal-sectional view of the bottle of Embodiment 1 showing how the ampule is removed from the recessed cavity. The bottle is shown with a cap and lid.

FIG. 6: is a cross-sectional view similar to FIG. 4 of the bottle of Embodiment 1 where the ampule has been removed from the recessed cavity.

Embodiment 2

Figure 7:
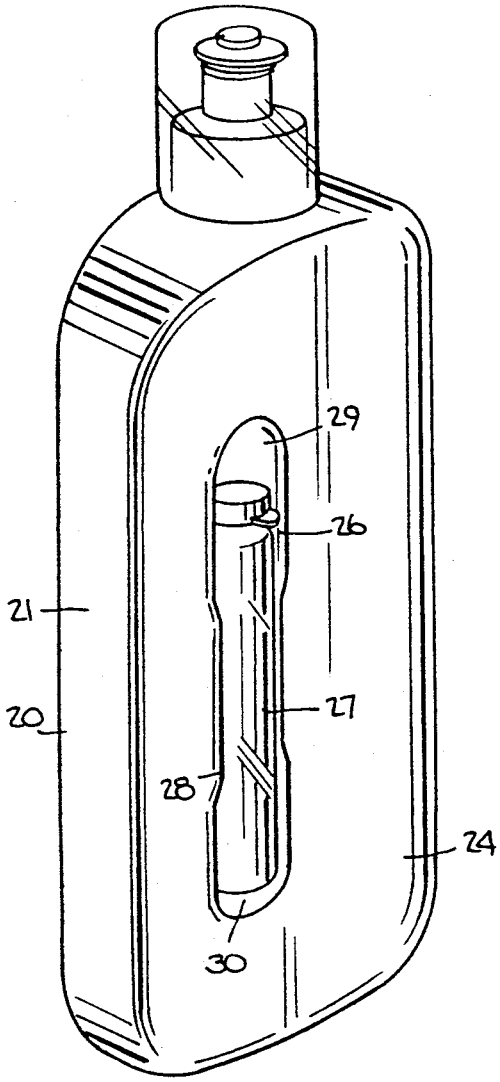

FIG. 7: is a perspective view of the bottle of Embodiment 2 wherein a glass ampule is nested into the recessed cavity. The bottle is shown with a lid and cap.

Figure 8:
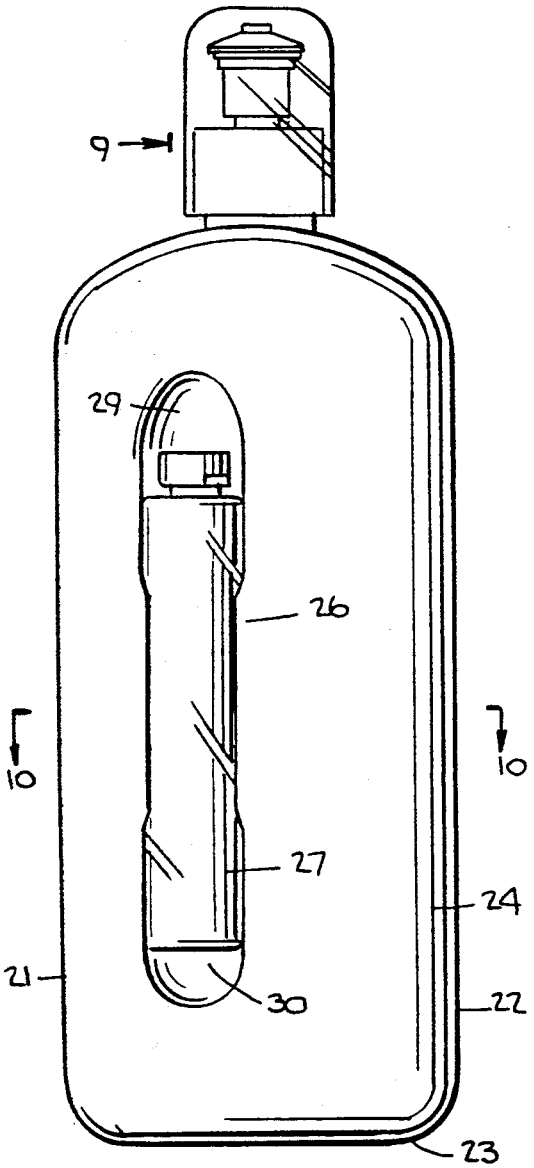

FIG. 8: is a front view of the bottle of Embodiment 2 containing a glass vial in the recessed cavity. The bottle is shown with a cap and lid.

Figure 9:
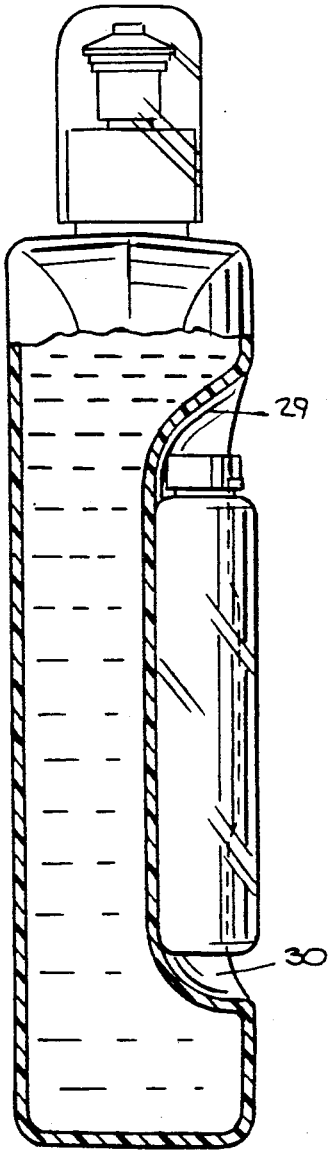

FIG. 9: is a left side elevational longitudinal-sectional view taken across 9—9 of FIG. 8 of the bottle of Embodiment 2 showing how the glass vial fits into the recessed cavity. The bottle is shown with a cap and lid.

Figure 10:
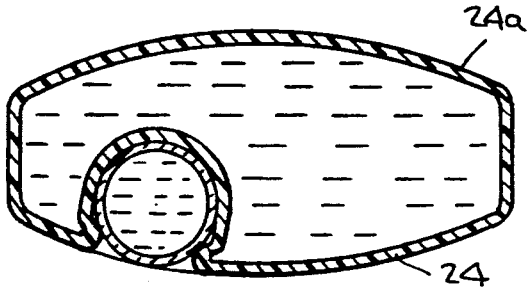

FIG. 10: is a cross-sectional view taken across 10—10 of FIG. 8 of the bottle of Embodiment 2.

Figure 11:
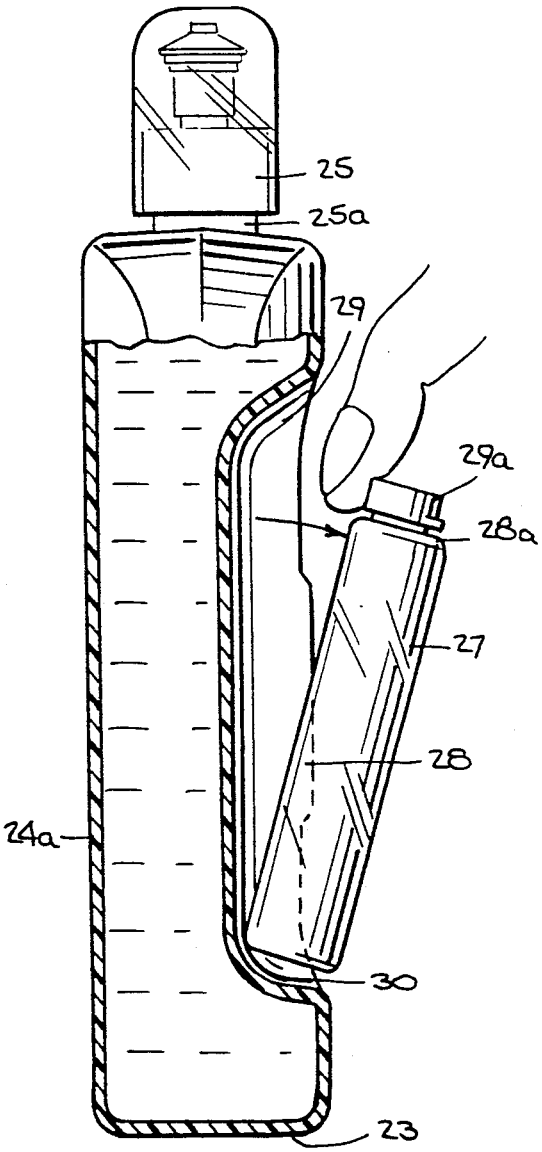

FIG. 11: is a left side elevational longitudinal-sectional view similar to FIG. 9 of the bottle of Embodiment 2 showing how the glass vial is removed from the recessed cavity.

Figure 12:
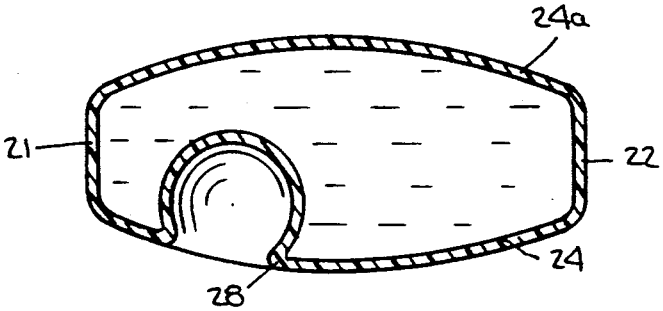

FIG. 12: is a cross-sectional view similar to FIG. 10 wherein the glass vial has been removed from the recessed cavity.

DESCRIPTION OF THE PREFERRED EMBODIMENT

Each of the preferred embodiments of the invention will be discussed.

Embodiment 1

Figure 1:
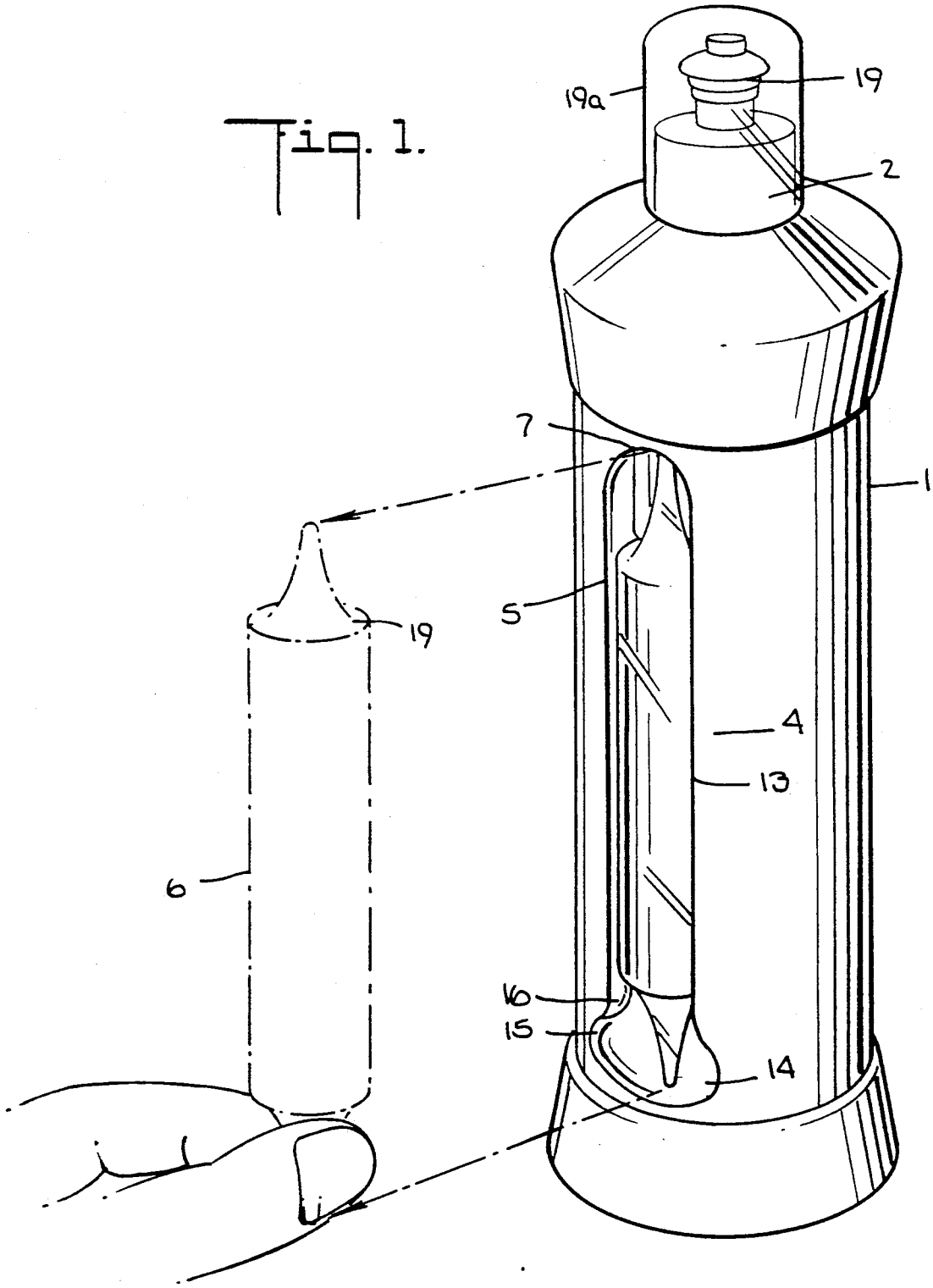
FIG. 1: is a front perspective view of the bottle of Embodiment 1 showing showing how the ampule is removed from the recessed cavity. The bottle is shown with a cap and lid.
Figure 2:
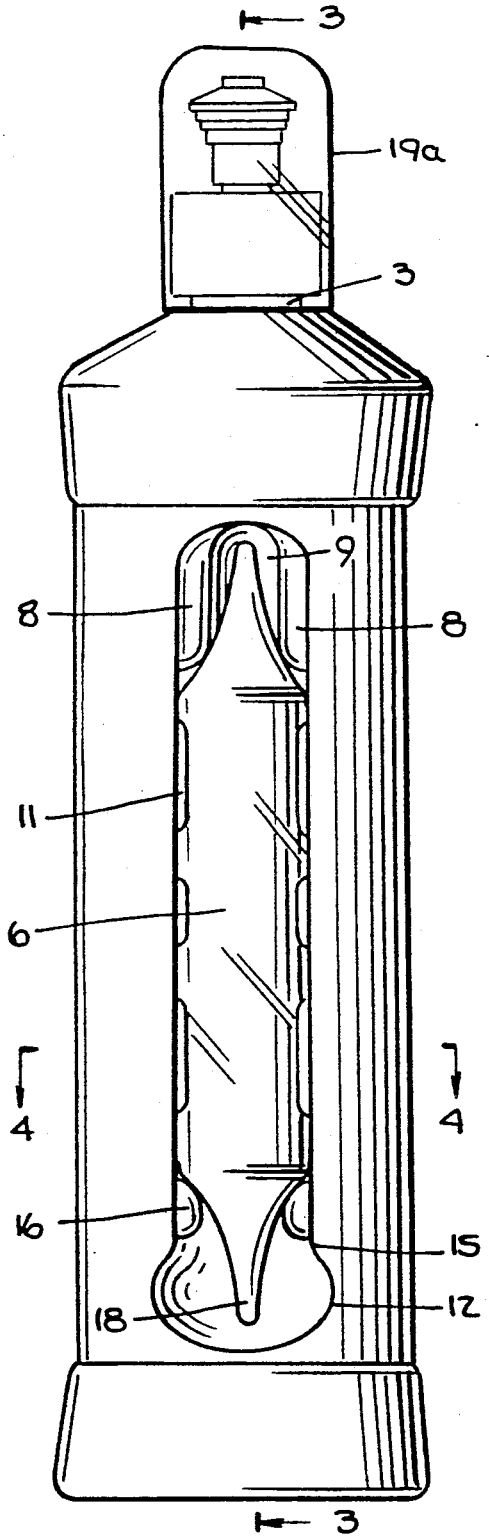
FIG. 2: is a front elevational view of the bottle of Embodiment 1 showing the ampule in place within the recessed cavity. The bottle is shown with a cap and lid.
Figure 3:
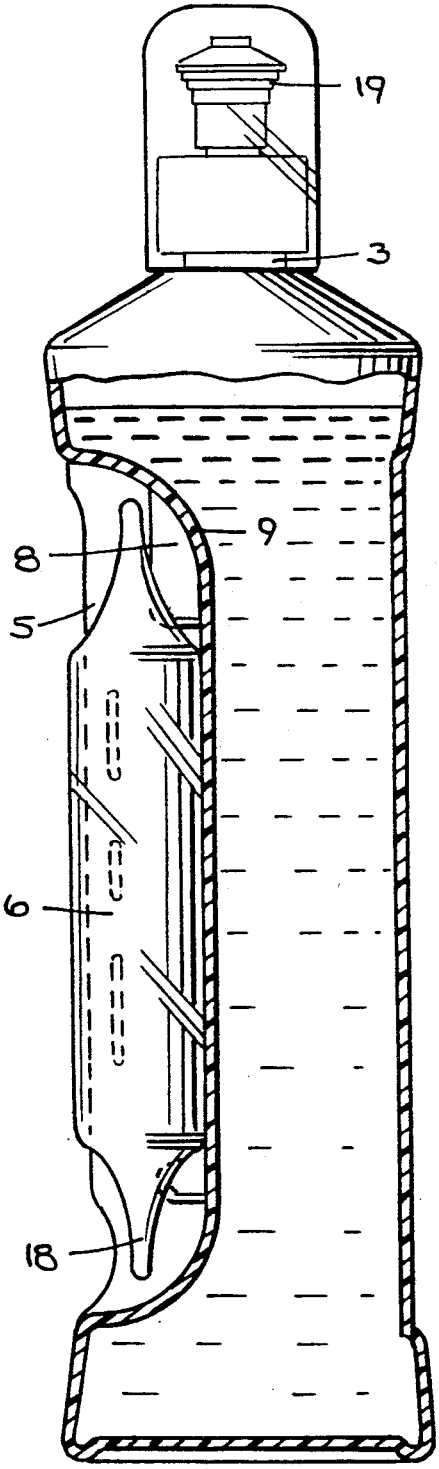
FIG. 3: is a right side elevational longitudinal-sectional view taken across 3—3 of FIG. 2, showing how the ampule fits into the recessed cavity of the bottle of Embodiment 1.

Referring to the drawings beginning with FIG. 1, a large container 1 in the form of a round, shouldered bottle is indicated by the number 1 this container being basically cylindrically shaped and having a cap 2 removably threaded onto a neck or spout 3. The bottle is shown with a lid 19*a* which fits over the cap 2 snugly engaging at its bottom half with the cap 2. In the wall 4 of the bottle 1 is one cylindrically shaped vertical recessed cavity 5 which balloons at its lower end 12. The recessed cavity 5 is sufficient size to receive in snapping relation a nested container means 6 which in this case is illustrated as an ampule. The recessed cavity 5 contains at its upper end 7 a pair of rectangular projections 8 on each side of the innermost area of the upper cavity, which project outwardly from the innermost area of the upper cavity 9 and terminate about halfway out of the innermost area of the cavity. These projections 8 serve as an upper anchor to seat the top shoulders 19 of the nested container means 6 so that it remains vertically in place. On the sides of the cavity 10 and in the midsection near the outermost edge of the cavity between the upper end 7 and the lower end 12 of the recessed cavity are placed one or more slight projections 11 close to the outer edge 13 of the cavity 5. These slight projections 11 form a securing means which allows the nested container means 6 to be held in place laterally yet easily removed outwardly by inserting fingers into the round recessed cavity 14 as shown in FIGS. 1 and 5 to reach the container means 6, and removably snapping the container means 6 from the recessed cavity with a snapping motion. Fingers will easily fit into the round recessed cavity 14 formed by the ballooned lower end 12 of the vertical recessed cavity. Just prior to the point where the cylindrical recessed cavity balloons 15 on the innermost portion of the cavity are placed on each side two small outwardly projecting semicircular ridges 16 which begin at the innermost portion of the cavity and terminate about halfway out of the cavity. These ridges act to form a seat for the bottom shoulders of the nested container means 6. The bottom ballooned portion of the recessed cavity 14 is of a size and depth sufficient to allow for insertion of fingers to grasp the pointed tip 18 of the nested container means 6 and to remove it from the cavity 5 by a gentle snapping outward. The outward snapping removal is achieved because the slight projections 11 protrude sufficiently to hold the nested container means 6 in place, yet the projections are small enough so that the gentle application of outward pressure such as that acheived by fingers pulling the pointed tip 18 outward as in FIGS. 1 and 5 will provide sufficient force to allow the nested container means 6 to be unsecured from behind the small projections 11. The bottle of Embodiment 1 may or may not contain a cap and lid as shown in FIGS. 1-6. In this Embodiment the bottle is shown with a screw cap 2 having a nozzle 19 which may be moved in the open and closed position by pushing down or pulling up. The bottle may also contain a lid 19*a* which fits over the cap 2 protecting nozzle 19. The lid 19*a* fits securely over the cap 2, engaging snugly with the bottom portion of the cap.

Embodiment 2

Referring to FIGS. 7-12 beginning with FIG. 7, a large container in the form of a flat shouldered bottle 20 with right 21 and left 22 sides parallel to each other and essentially perpendicular to the bottle base 23. The front 24 and back 24*a* surfaces of the bottle diverge slightly outward from the bottle sides to form a convex shape. The bottle has a cap 25 removably threaded onto a neck or spout 25*a*. On the front surface of the bottle in the wall thereof is one elliptically shaped vertical recessed cavity 26 of size sufficient to receive in snapping relation a nested container means 27 which in this case is a vial. On the sides of the cavity and in the middle area and on the outermost edge of the cavity between the upper and lower end of the recessed cavity are placed one or more slight projections 28 close to the outer edge of the cavity. These slight projections allow the nested container means 27 to be held in place laterally in the recessed cavity 26 yet easily removed by inserting fingers in the upper 29 or lower 30 portion of the cavity to remove the nested container means 27 by applying gentle outward pressure so that the nested container means is removed by a gentle snapping motion. The snapping motion arises due to the projections 28 which protrude sufficiently to hold the nested container means, yet the protrusions 28 are small enough so that the gentle application of outward pressure will allow the container means to snap out. In this case the nested container means illustrated is a glass vial 27 cylindrically shaped bearing a neck 28*a* at its upper end which bears a snap-off cap 29*a*.

The container of Embodiment 2 may also contain a lid and cap as described for Embodiment 1.

While the invention has been described in connection with the preferred embodiment it is not intended to limit the invention to the particular form set forth but on the contrary it is intended to cover such alternatives, modifications, and equivalents as may be included within the spirit and scope of the appended claims.

I claim:

1. A composite container comprising a cylindrically shaped flat shouldered bottle having on its front face a vertical cylindrically shaped recessed cavity having vertical side edges, said cavity including a finger receiving recess and being dimensioned to receive at least one smaller container which fits completely into said recessed cavity to provide a smooth front face, protrusions located on either side of said recessed cavity on said vertical side edges, said protrusions dimensioned to permit the smaller container to be laterally snapped in and out of the recessed cavity, said composite container thereby providing a single shelf keeping unit.

2. The composite container of claim 1 wherein each small container is a vial.

3. The composite container of claim 1 wherein said small container is an ampule.

4. The composite container of claim 1 wherein said small container is a glass vial.

5. The composite container of claim 1 wherein the small container is a glass ampule.

6. The composite container of claim 1 wherein the bottle includes a cap.

7. The composite container of claim 6 wherein the bottle further includes a lid.

8. A composite container comprising a rectangular shaped round shouldered bottle having on its front face a vertical cylindrically shaped recessed cavity having vertical side edges, said cavity including a finger receiving recess and being dimensioned to receive at least one smaller container which fits completely into said recessed cavity to provide a smooth front face, protrusions located on either side of said recessed cavity on said vertical side edges, said protrusions dimensioned to permit the smaller container to be laterally snapped in and out of the recessed cavity, said composite container thereby providing a single shelf keeping unit.

9. The composite container of claim 8 wherein said small container is a vial.

10. The composite container of claim 8 wherein said small container is an ampule.

11. The composite container of claim 8 wherein said small container is a glass vial.

12. The composite container of claim 8 wherein said small container is a glass ampule.

13. The composite container of claim 8 wherein the bottle includes a cap.

14. The composite container in claim 13 wherein the bottle further includes a lid.

* * * * *